US010894286B2

(12) United States Patent
Wilkes et al.

(10) Patent No.: US 10,894,286 B2
(45) Date of Patent: Jan. 19, 2021

(54) HIGH-PRESSURE DIE CASTING APPARATUS AND METHOD

(71) Applicants: Richard John Wilkes, Alliston (CA); Owen Michael Zelina, Brampton (CA); Xiaoping Niu, Richmond Hills (CA)

(72) Inventors: Richard John Wilkes, Alliston (CA); Owen Michael Zelina, Brampton (CA); Xiaoping Niu, Richmond Hills (CA)

(73) Assignee: Magna International Inc., Aurora (CA)

( * ) Notice: Subject to any disclaimer, the term of this patent is extended or adjusted under 35 U.S.C. 154(b) by 166 days.

(21) Appl. No.: 16/170,538

(22) Filed: Oct. 25, 2018

(65) Prior Publication Data

US 2019/0060986 A1 Feb. 28, 2019

Related U.S. Application Data

(62) Division of application No. 15/021,691, filed as application No. PCT/IB2014/002658 on Sep. 19, 2014, now Pat. No. 10,137,498.

(60) Provisional application No. 61/879,789, filed on Sep. 19, 2013.

(51) Int. Cl.

| | |
|---|---|
| ***B22D 17/20*** | (2006.01) |
| ***B22D 17/22*** | (2006.01) |
| ***B22D 17/10*** | (2006.01) |
| ***B22D 17/00*** | (2006.01) |

(52) U.S. Cl.

CPC ..... *B22D 17/10* (2013.01); *B22D 17/002* (2013.01); *B22D 17/203* (2013.01); *B22D 17/2007* (2013.01); *B22D 17/2023* (2013.01); *B22D 17/2272* (2013.01)

(58) Field of Classification Search

CPC ..... B22D 17/20; B22D 17/22; B22D 17/2272

See application file for complete search history.

(56) References Cited

U.S. PATENT DOCUMENTS

| | | | | |
|---|---|---|---|---|
| 1,939,831 | A * | 12/1933 | Scheible | B22D 17/22 164/304 |
| 2009/0211724 | A1 | 8/2009 | Moret et al. | |
| 2016/0067772 | A1 * | 3/2016 | Yokoyama | B22D 17/22 164/319 |

FOREIGN PATENT DOCUMENTS

| | | | |
|---|---|---|---|
| JP | 2012125792 | A1 | 7/2012 |

* cited by examiner

*Primary Examiner* — Kevin E Yoon

(74) *Attorney, Agent, or Firm* — Dickinson Wright PLLC

(57) ABSTRACT

A high-pressure die casting apparatus including a shot sleeve extending through a first die half to a molding surface, and a plunger received in the shot sleeve is provided. The shot sleeve includes a side wall presenting a fluid passageway and a partial end wall disposed in a fixed position relative to the side wall. The partial end wall defines a wall opening adjacent the molding surface. Fluid is poured into the shot sleeve while the die apparatus is open, and the partial end wall prevents the fluid from flowing out of the shot sleeve. The plunger then presses the material into the mold cavity until only a portion of the material remains in the shot sleeve and blocks the wall opening. After the solidified material is ejected from the apparatus, the portion of material blocking the wall opening prevents lubricant from entering the shot sleeve.

8 Claims, 14 Drawing Sheets

FIG. 2A
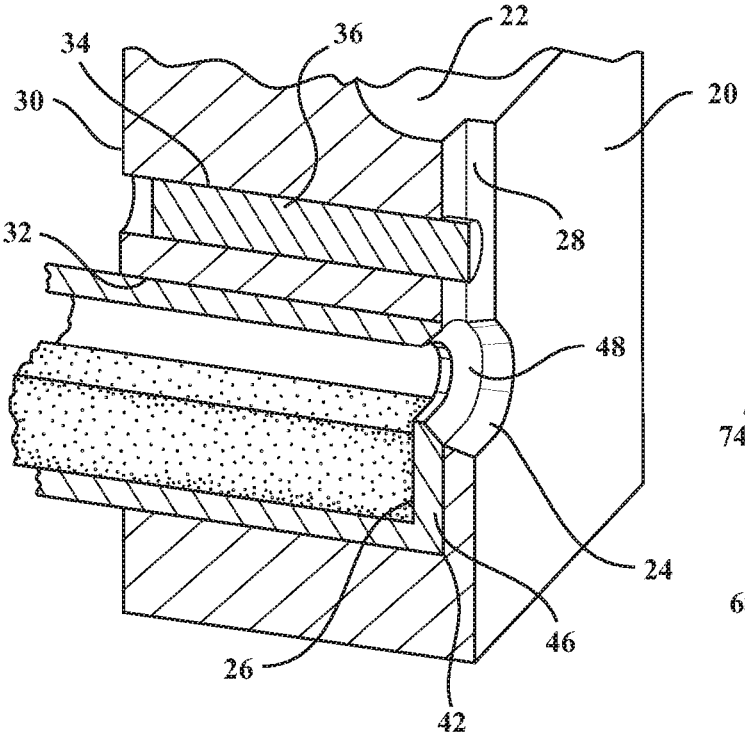
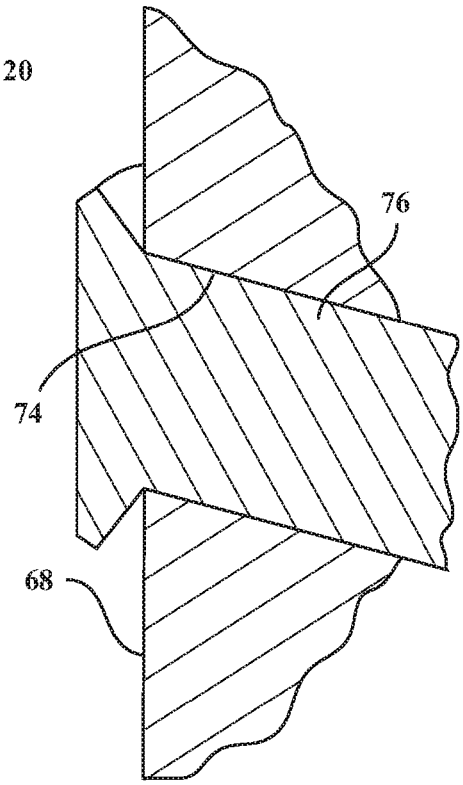
FIG. 2C
FIG. 2B
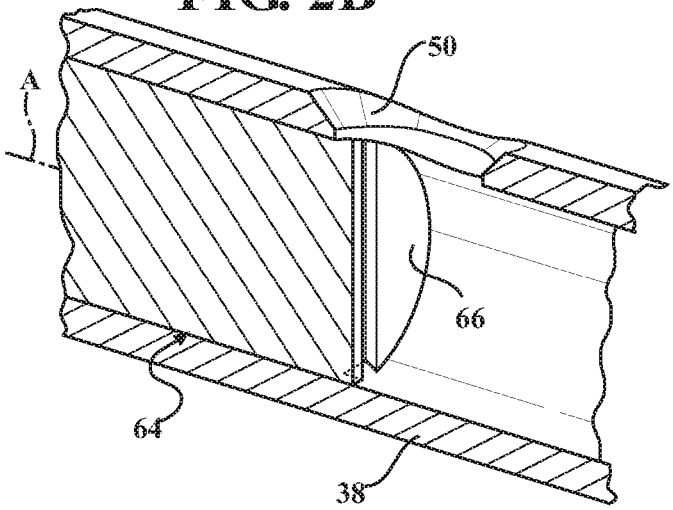
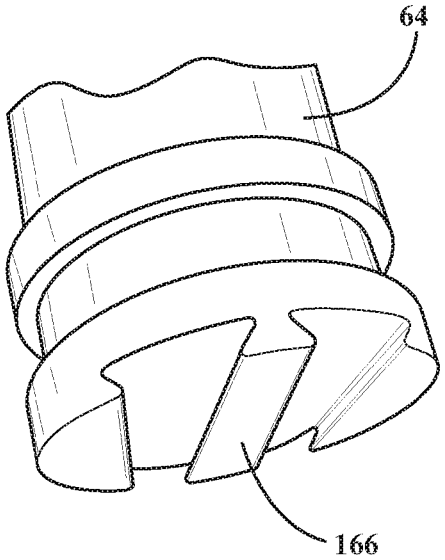
FIG. 2D

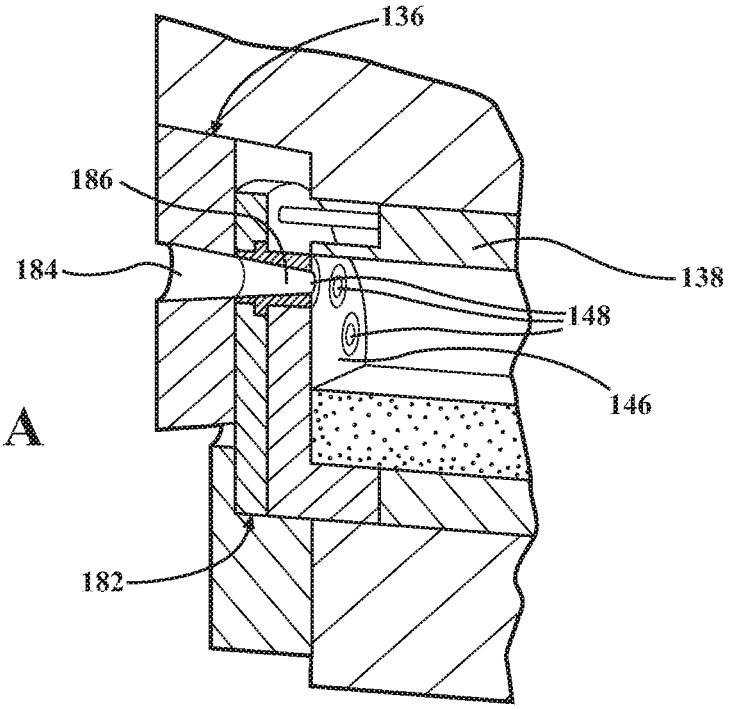
FIG. 9A
FIG. 9B
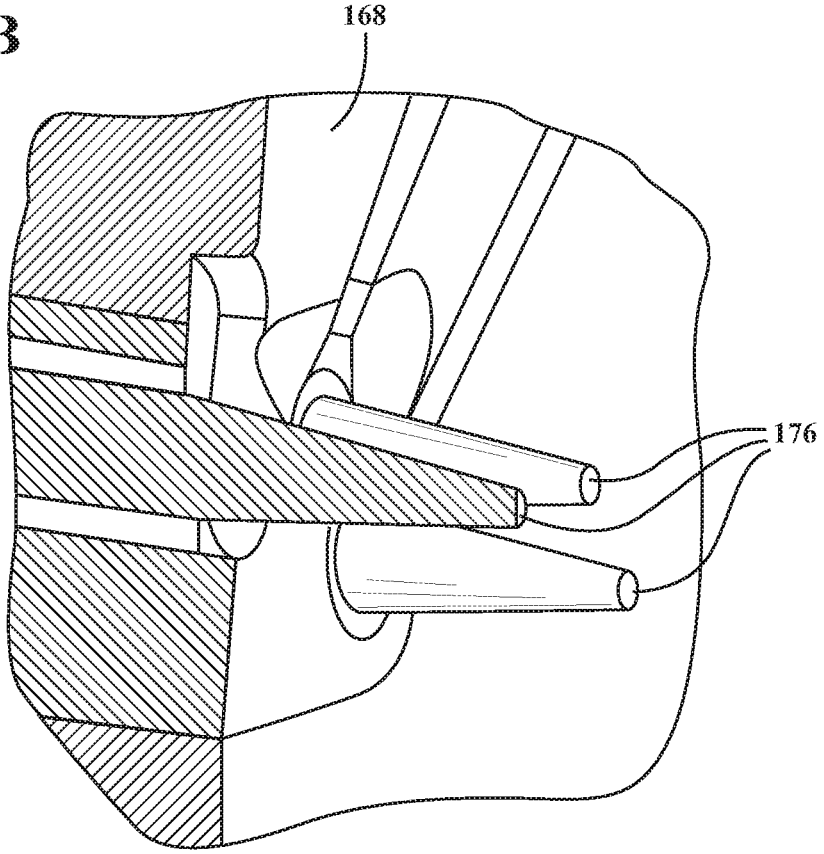

HIGH-PRESSURE DIE CASTING APPARATUS AND METHOD

CROSS-REFERENCE TO RELATED APPLICATIONS

This U.S. Divisional Patent Application claims the benefit of U.S. National Stage patent application Ser. No. 15/021,691 filed on Mar. 12, 2016 entitled "High-Pressure Die Casting Apparatus And Method" which claims the benefit of PCT International Patent Application Serial No. PCT/IB2014/002658 filed Sep. 19, 2014 entitled "High-Pressure Die Casting Apparatus And Method," which claims the benefit of U.S. Provisional Patent Application Ser. No. 61/879,789 filed Sep. 19, 2013, entitled "High Pressure Die Casting Apparatus And Method," the entire disclosures of the applications being considered part of the disclosure of this application and hereby incorporated by reference.

BACKGROUND OF THE INVENTION

1. Field of the Invention

The invention relates generally to an apparatus and method for high-pressure die casting.

2. Related Art

High-pressure die casting is oftentimes used to manufacture parts formed of metal or another material. A high-pressure die casting apparatus typically includes a first die half and a second die half each presenting a molding surface. When the die apparatus is closed, the molding surfaces present a mold cavity therebetween. A shot sleeve extends through one of the die halves and conveys molten material to the mold cavity. In a conventional high-pressure die casting process, the molten material is not poured into the shot sleeve until the die apparatus is closed, otherwise the molten material will flow out of the shot sleeve causing a potential safety issue and causing the casting process to fail.

U.S. Patent Application Publication No. 2009/0211724 (the '724 publication) discloses a die casting device and method providing reduced cycle times and thus an advantage over the conventional casting process. The die casting device includes molding surfaces presenting a mold cavity therebetween, a shot sleeve having an opening along one of the molding surfaces, and a slider disposed along the molding surface adjacent the opening of the shot sleeve. The slider at least partially seals the opening while molten material is poured into the shot sleeve. Thus, the molten material can be poured into the shot sleeve when the die casting device is still open, which reduces the cycle time. After the solidified part is ejected from the device and the excess material is removed from the shot sleeve, the method includes spraying a lubricant onto the molding surfaces in preparation for the next casting cycle. However, there are several potential problems associated with the device and method described in the '724 publication which could increase cycle time and decrease productivity. For example, the slider could malfunction and may not correctly align with the opening of the shot sleeve. The slider could also cause excessive material flashes or blockage along the opening of the shot sleeve, due to high-pressure and dynamic impact of the material against the slider. In addition, the lubricant sprayed onto the molding surfaces could become entrapped in the shot sleeve.

SUMMARY OF THE INVENTION

The invention provides a die apparatus for die casting. The die apparatus comprises a first die half having a first molding surface and a second die half having a second molding surface, and the molding surfaces present a mold cavity therebetween. A shot sleeve extends through the first die half to the first molding surface and includes a side wall presenting a fluid opening for conveying fluid. The side wall extends to a partial end wall which defines at least one wall opening for allowing fluid to flow from the fluid opening toward the mold cavity. The partial end wall prevents the fluid from flowing out of the shot sleeve and thus allows the fluid to be poured into the shot sleeve when the die apparatus is still open. A plunger is disposed in the shot sleeve for pressing the fluid through the at least one wall opening and into the mold cavity. According to one embodiment, a material separator is disposed along one of the molding surfaces and is movable relative to the molding surface. In another embodiment, at least one hold pin extends upwardly from the second molding surface, and each of the hold pins is axially aligned with one of the wall openings.

The invention also provides a die casting method. The method comprises disposing fluid in the shot sleeve while the first molding surface is spaced from the second molding surface, and then moving at least one of the die halves toward the other to present the mold cavity therebetween. The method next includes pressing the fluid through the wall opening of the shot sleeve into the mold cavity until only a portion of the fluid remains in the shot sleeve and blocks the wall opening. The method then includes moving at least one of the die halves away from the opposite die half while the portion of the fluid blocks the wall opening and is at least partially molten.

The apparatus and method of the present invention provides several advantages over conventional die apparatuses and methods used for die casting, such as the die casting device and method described in the '724 publication. The stationary partial end wall of the shot sleeve allows the fluid to be poured into the shot sleeve while the die apparatus is still open, for example while spraying lubricant onto the molding surfaces. Furthermore, the die apparatus can be re-opened before the biscuit fully solidifies, which also reduces the cycle time. In addition, after the solidified material is ejected from the die casting apparatus, the portion of material remaining in the shot sleeve blocks the at least one wall opening and thus prevents the lubricant spray from entering the shot sleeve, which improves productivity of the casting process.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2A is an enlarged view of a portion of the die apparatus of FIG. 2 showing a die opening of a first die half and a wall opening of a shot sleeve;

FIG. 2B is an enlarged view of another portion of the die apparatus of FIG. 2 showing a serrated surface of a plunger head;

FIG. 2C is an enlarged view of yet another portion of the die apparatus of FIG. 2 showing a hold pin disposed in a second die half;

FIG. 2D is a front perspective view of a plunger head having a dove tail design;

FIG. 9A is an enlarged view of a portion of the upper die half of the die apparatus of FIG. 9;

FIG. 9B is an enlarged view of a portion of the lower die half of the die apparatus of FIG. 9;

DETAILED DESCRIPTION OF THE ENABLING EMBODIMENT

Figure 1:
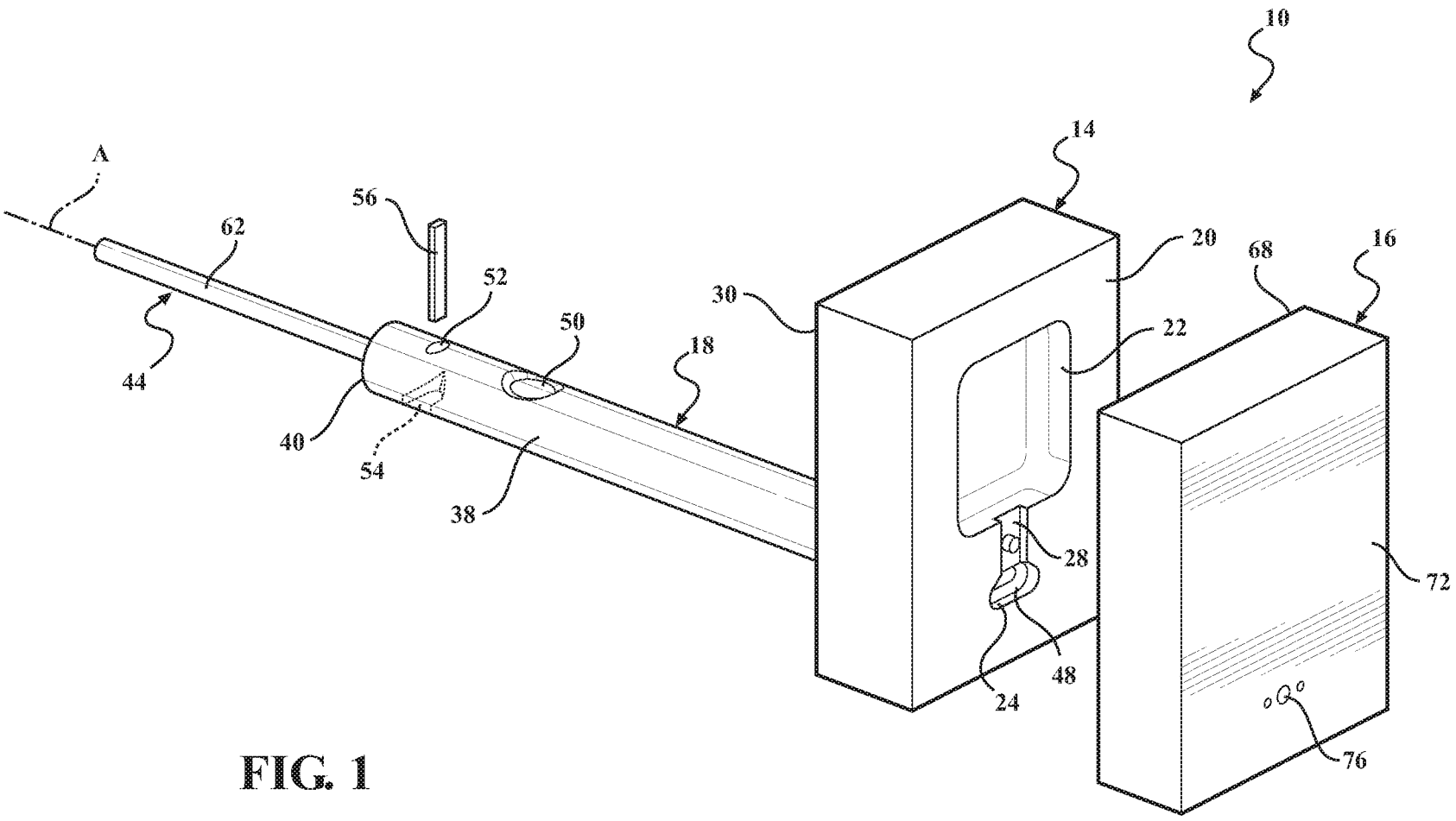
FIG. 1 is a perspective view of a die apparatus in an open position at the beginning of a casting process according to a first exemplary embodiment.

The invention provides a die apparatus 10 for die casting of parts 12, such as high-pressure die casting of chassis or body components for automotive vehicles. The die apparatus 10 is typically used to cast metal parts, such as parts formed of aluminum. However, the die apparatus 10 can also be used to cast parts formed of other materials. The die apparatus 10 comprises a first die half 14, a second die half 16, and shot sleeve 18 which are capable of providing a reduced cycle time and increased productivity. A perspective view of the die apparatus 10 according to a first exemplary embodiment is shown in FIG. 1. FIGS. 2-7 are cross-sectional views of the first exemplary die apparatus 10 during different stages of the casting process.

In the exemplary embodiment of FIGS. 1-7, the first die half 14 comprises a block with a first molding surface 20 facing the second die half 16. The first die half 14 is fixed in position relative to the second die half 16, and the two die halves 14, 16 provide a mold cavity therebetween when the die apparatus 10 is closed. Alternatively, the first die half 14 could be movable, and the second die half 16 could be fixed. The first molding surface 20 of the first die half 14 presents contour for shaping any type of fluid, which is typically a molten material. In the first exemplary embodiment, the first molding surface 20 presents a recessed area 22 for receiving the molten material and shaping the molten material into the part 12. The shape and dimensions of the first molding surface 20 vary depending on the part 12 to be formed. The first molding surface 20 also presents a die opening 24 for receiving the molten metal from the shot sleeve 18. A channel 28 extends from the die opening 24 to the recessed area 22 for conveying the molten material from the die opening 24 to the recessed area 22. In the exemplary embodiment of FIGS. 1-7, the dimensions of the recessed area 22 are greater than the dimensions of the die opening 24 and greater than the dimensions of the channel 28. However, the depth of the die opening 24 and the depth of the channel 28, relative to the first molding surface 20, are approximately equal.

The first die half 14 also includes a back surface 30 opposite the first molding surface 20. A sleeve opening 32 for receiving the shot sleeve 18 extends continuously from the back surface 30 to the first molding surface 20. In the first exemplary embodiment, the die opening 24 is part of, or in fluid communication with, the sleeve opening 32 so that the molten material can flow continuously through the shot sleeve 18 and the die opening 24 to the first molding surface 20. The sleeve opening 32 also extends to a support ledge 26 formed in the first die half 14 and defining the die opening 24. The support ledge 26 is disposed parallel to the first molding surface 20, as best shown in FIG. 2A. The shot sleeve 18 is designed to fit securely in the sleeve opening 32 against the support ledge 26. The sleeve opening 32 and the die opening 24 each present a cross-sectional area extending parallel to the first molding surface 20, and the cross-sectional area of the die opening 24 is less than the cross-sectional area of the remaining portions of the rest of the sleeve opening 32. In the exemplary embodiment, the sleeve opening 32 presents a cylindrical shape between the back surface 30 and the die opening 24, and the cross-sectional area of the die opening 24 is approximately half of the cross-sectional area of the sleeve opening 32. The support ledge 26 of the first die half 14 is designed to support the shot sleeve 18 and space the shot sleeve 18 from the first molding surface 20. In the exemplary embodiment, the support ledge 26 extends parallel to the first molding surface 20 and traverse to the sleeve opening 32. As shown in FIG. 2A, the die opening 24 is tapered such that the cross-sectional area of the die opening 24 increases slightly in a direction moving toward the first molding surface 20.

The first die half 14 also defines a material separator opening 34, which in this embodiment is push pin opening, extending continuously from the back surface 30 to the channel 28 of the first molding surface 20. The material separator opening 34 also presents a cross-sectional area parallel to the first molding surface 20, which is less than the cross-sectional area of the sleeve opening 32. A material separator 36, which in this embodiment is a push pin, fits tightly in the material separator opening 34 and is capable of moving toward and away from the first molding surface 20. At the end of the casting process, the material separator 36 assists in separating the portion of material remaining in the shot sleeve 18 from the material disposed between the first and second molding surfaces 20, 68. The material separator 36 also assists in ejecting the solidified material from the first molding surface 20.

As stated above, the shot sleeve 18 is received in the sleeve opening 32 of the first die half 14 and conveys the molten material to the first molding surface 20. In the exemplary embodiment, the shot sleeve 18 includes a side wall 38 extending along a center axis A from a first end 40 to a second end 42. The side wall 38 also extends circumferentially around the center axis A and thus presents a tubular shape. The side wall 38 of the shot sleeve 18 also forms a fluid passage along the center axis A for conveying the molten material toward the mold cavity. The first end 40 of the shot sleeve 18 is open for receiving a plunger 44, which will be discussed further below.

The shot sleeve 18 also includes a partial end wall 46 located at the second end 42 of the shot sleeve 18 to partially close the second end 42 and prevent the molten material from flowing to the first molding surface 20 when the die apparatus 10 is open. Thus, the molten material can be poured into the shot sleeve 18 when the die apparatus 10 is still open, unlike other die apparatuses which must be closed before the molten material is poured into the shot sleeve. The partial end wall 46 is disposed in a stationary, fixed position relative to the side wall 38. The partial end wall 46 and the side wall 38 can comprise a homogenous, one-piece structure, or can comprise separate pieces fixed to one another. Unlike other die apparatuses with sliding end walls to expose the fluid passage, the partial end wall 46 of the present invention does not move relative to the side wall 38. When the shot sleeve 18 is disposed in the sleeve opening 32 of the first die half 14, the partial end wall 46 is disposed on and aligned with the support ledge 26 of the first die half 14, as best shown in FIG. 2A. The partial end wall 46 presents a cross-sectional area disposed parallel to said first molding surface 20 which is typically equal to or greater than one third of the cross-sectional area of the fluid passage. In an alternate embodiment, the support ledge 26 could be removed, and the partial end wall 46 could present a portion the first molding surface 20.

The side wall 38 and partial end wall 46 of the shot sleeve 18 together define a wall opening 48, which is aligned with the die opening 24, to allow the molten material to flow from the shot sleeve 18 into the mold cavity when the die apparatus 10 is closed. The wall opening 48 is typically disposed on one side of the shot sleeve 18, and the partial end wall 46 is disposed on the other side. Like the die opening 24, the wall opening 48 has a cross-sectional area extending parallel to the first molding surface 20. In the first exemplary embodiment, the cross-sectional area of the wall opening 48 is approximately half of the cross-sectional area of the sleeve opening 32. The partial end wall 46 and side wall 38 of the shot sleeve 18 are tapered around the wall opening 48, such that the cross-sectional area of the wall opening 48 increases slightly in a direction moving toward the first molding surface 20, just like the die opening 24. The aligned wall opening 48 and die opening 24 can together be referred to as a sprue opening, because during the casting process, the molten material in the form of a sprue is disposed in those aligned openings 24, 48.

The side wall 38 of the shot sleeve 18 includes a pouring hole 50 for receiving the molten material. In the exemplary embodiment, the pouring hole 50 is located closer to the first end 40 than the second end 42. The pouring hole 50 is also disposed on the same side of the shot sleeve 18 as the wall opening 48, so that the partial end wall 46 prevents the molten material poured into the shot sleeve 18 from entering the mold cavity until the plunger 44 presses the material through the wall opening 48.

In the first exemplary embodiment, the side wall 38 of the shot sleeve 18 also includes a receiving hole 52 on the same side as the pouring hole 50. The receiving hole 52 is located between the pouring hole 50 and the first end 40. A biscuit knock out hole 54 is also provided in the shot sleeve 18, directly opposite the receiving hole 52. The receiving hole 52 receives a biscuit knock out component 56, in this case a push pin, which is designed to push a portion of the material, referred to as a biscuit 58, through the biscuit knock out hole 54. This process is discussed further below.

The die apparatus 10 also comprises the plunger 44 received in the fluid passage of the shot sleeve 18 for pressing the molten material through the wall opening 48 of the shot sleeve 18 and into the mold cavity. As shown in the Figures, the plunger 44 includes a plunger rod 62 attached to a plunger head 64. The plunger head 64 has the same shape as the fluid passage of the shot sleeve 18, and a cross-sectional area approximately equal to that of the fluid passage, and thus fits tightly against the side wall 38 of the shot sleeve 18. The plunger head 64 is capable of sliding along the side wall 38 toward the partial end wall 46 to press the molten material through the shot sleeve 18. The plunger head 64 preferably presents a serrated surface 66 facing the partial end wall 46 for engaging the molten material during the casting process, which will be discussed further below. The serrated surface 66 includes serrations or notches for engaging the material. In the exemplary embodiment, the serrations comprise a dove tail design, as best shown in FIGS. 2B and 2D.

The die apparatus 10 of the first exemplary embodiment further includes the second die half 16, which is aligned with the first die half 14 and movable relative to the first die half 14. At the start of the casting process, the second die half 16 and first die half 14 are spaced from one another, which is referred to as the die apparatus 10 being open. The molten metal is poured into the shot sleeve 18 while the die apparatus 10 is open. Next, the second die half 16 moves toward the first die half 14 until the two halves 14, 16 engage one another and present the mold cavity therebetween. This is referred to as the die apparatus 10 being closed. The plunger 44 then presses the molten material into the mold cavity to form the part 12.

As shown in the Figures, the second die half 16 also comprises a block of material with a second molding surface 68 facing and aligned with the first molding surface 20, so that the molding surfaces 20, 68 form the mold cavity therebetween when the die apparatus 10 is closed. The second molding surface 68 presents a contour for shaping the molten material, which in this case is a protruded area 70 having a shape and dimensions that match the recessed area 22 of the first die half 14. However, the portion of the second molding surface 68 surrounding the protruded area 70 is flat and does not include any feature corresponding to the channel 28 or the die opening 24 of the first die half 14.

Figure 7:
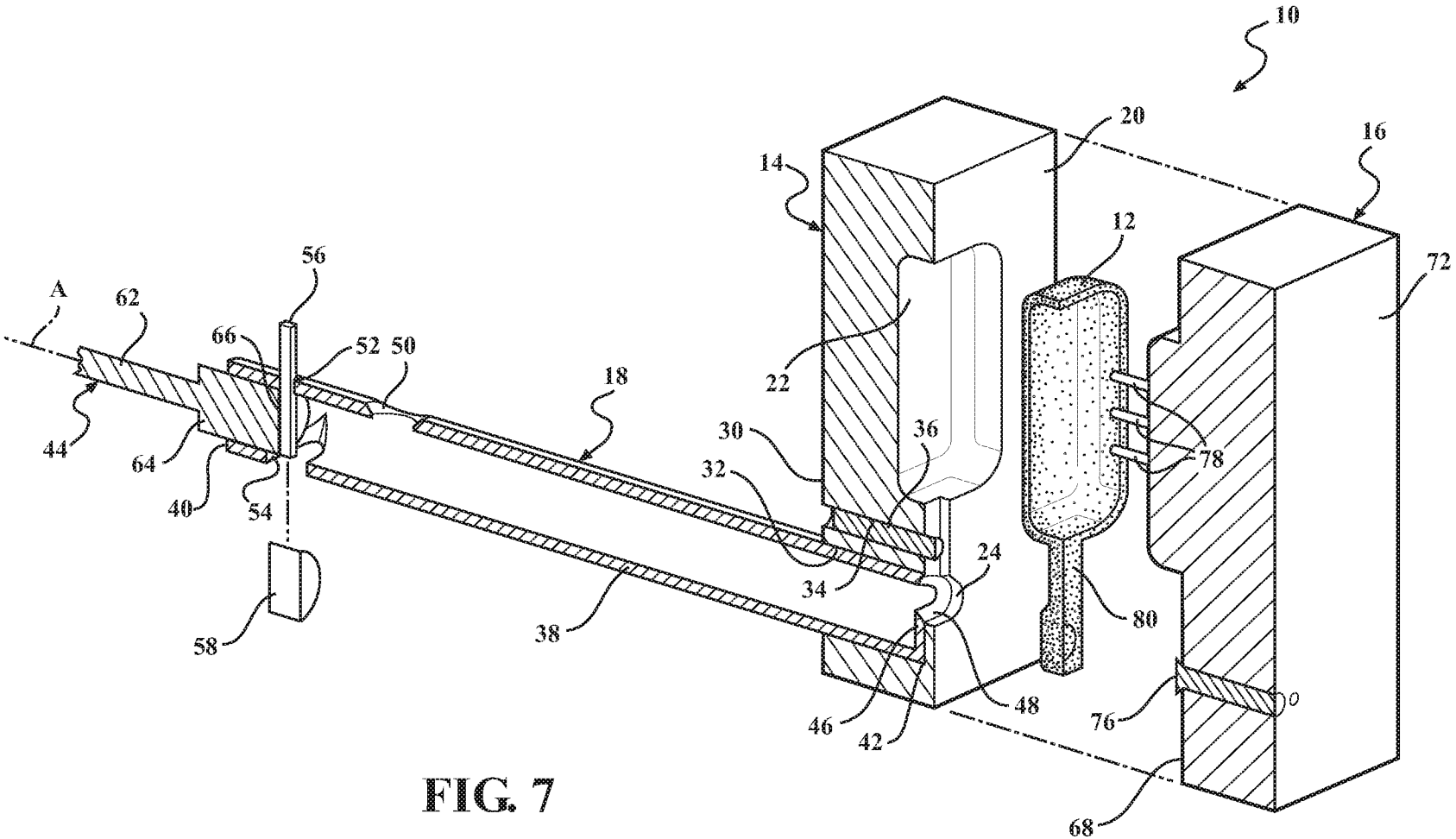
FIG. 7 is a cross-sectional view of the first exemplary die apparatus after the solidified material is ejected from the molding surface and after the biscuit is removed from the shot sleeve.

The second die half 16 also includes a second back surface 72 opposite the second molding surface 68. A hold pin opening 74 extends through the second die half 16 to the second molding surface 68. In the exemplary embodiment, the hold pin opening 74 is aligned with the die opening 24 of the first die half 14. Also, the cross-sectional area of the hold pin opening 74 is less than the cross-sectional area of the die opening 24. A hold pin 76 is disposed in the hold pin opening 74 and remains in a fixed position throughout the casting process. The hold pin 76 is axially aligned with the die opening 24 of the first die half 14 and the wall opening 48 of the shot sleeve 18. The hold pin 76 also has an enlarged head which is disposed slightly above the second molding surface 68 and tapers toward the second molding surface 68, as best shown in FIG. 2C. When the die apparatus 10 is closed, the head of the hold pin 76 is disposed in the die opening 24, but not the wall opening 48. During the casting process, the molten material flows around the hold pin 76 and into the mold cavity. The hold pin 76 increases the pressure along the die opening 24 and thus increases the rate at which the molten material flows into the mold cavity. The hold pin 76 also holds the part 12 on the molding surface 68 when the die apparatus 10 first opens and before the part 12 is ejected, so that the part 12 does not immediately fall off the molding surface 68 when the second die half 16 moves away from the first die half 14. A distributor, which is typically located in the moving die half and aligned with the opening of the shot sleeve, for guiding the molten material through the shot sleeve to the mold cavity, can be eliminated in the inventive die apparatus 10. Ejection pins 78 are also typically received in the second die half 16, as shown in FIG. 7. The ejection pins 78 move upwardly and outwardly of the second molding surface 68 to eject the part 12 at the end of the casting process.

Figure 2:
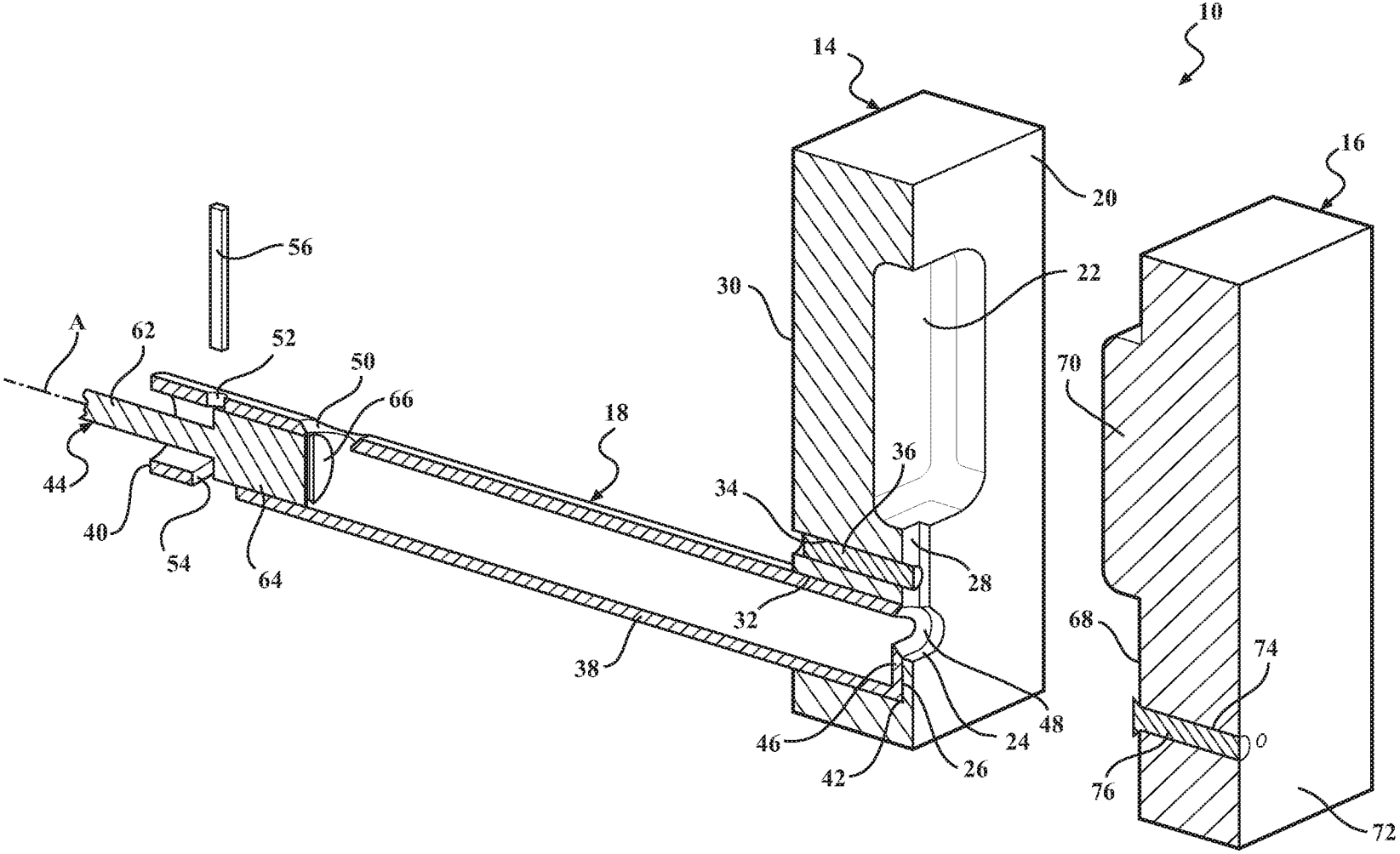
FIG. 2 is a cross-sectional view of the exemplary die apparatus of FIG. 1.

The invention also provides a method for die casting using the first exemplary die apparatus 10. As shown in FIGS. 1 and 2, the method begins with the die apparatus 10 in the open position, wherein the first die half 14 and the second die half 16 are spaced from one another. The plunger 44 is received in the shot sleeve 18 such that the plunger head 64 is located between the pouring hole 50 and the receiving hole 52. The serrated surface 66 of the plunger head 64 is aligned with an edge of the pouring hole 50 and does not block the pouring hole 50. Also in the starting position, the biscuit knock out component 56 is outside of the receiving hole 52, and the enlarged end of the hold pin 76 is disposed slightly past the second molding surface 68.

Figure 3:
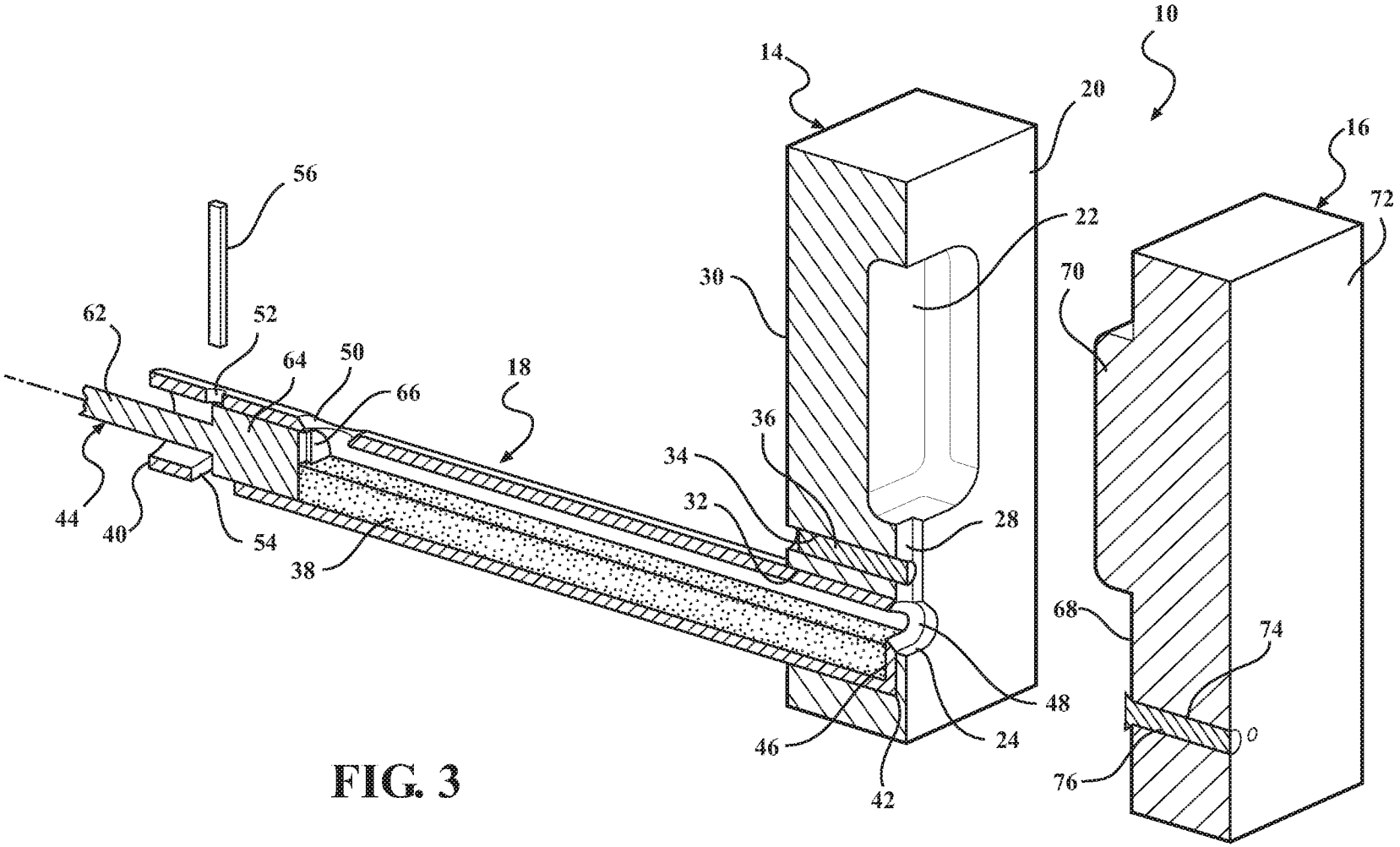
FIG. 3 is a cross-sectional view of the first exemplary die apparatus showing fluid disposed in the shot sleeve while the die apparatus is open.

While the die apparatus 10 is still open, the method includes pouring molten material, or another fluid, through the pouring hole 50 into the shot sleeve 18. The molten material flows through the fluid passage toward the partial end wall 46 and the wall opening 48 of the shot sleeve 18. The amount of molten material poured into the shot sleeve 18 and the rate at which the molten material is poured is such that the molten material remains below the wall opening 48 of the partial end wall 46 while the die apparatus 10 is still open. The molten material is poured into the shot sleeve 18 until it rises to a level along the partial end wall 46 which is slightly below the wall opening 48, as shown in FIG. 3. The partial end wall 46 and the support ledge 26 of the upper die half 14 prevent the molten material from flowing out of the shot sleeve 18 onto the first molding surface 20.

Figure 4:
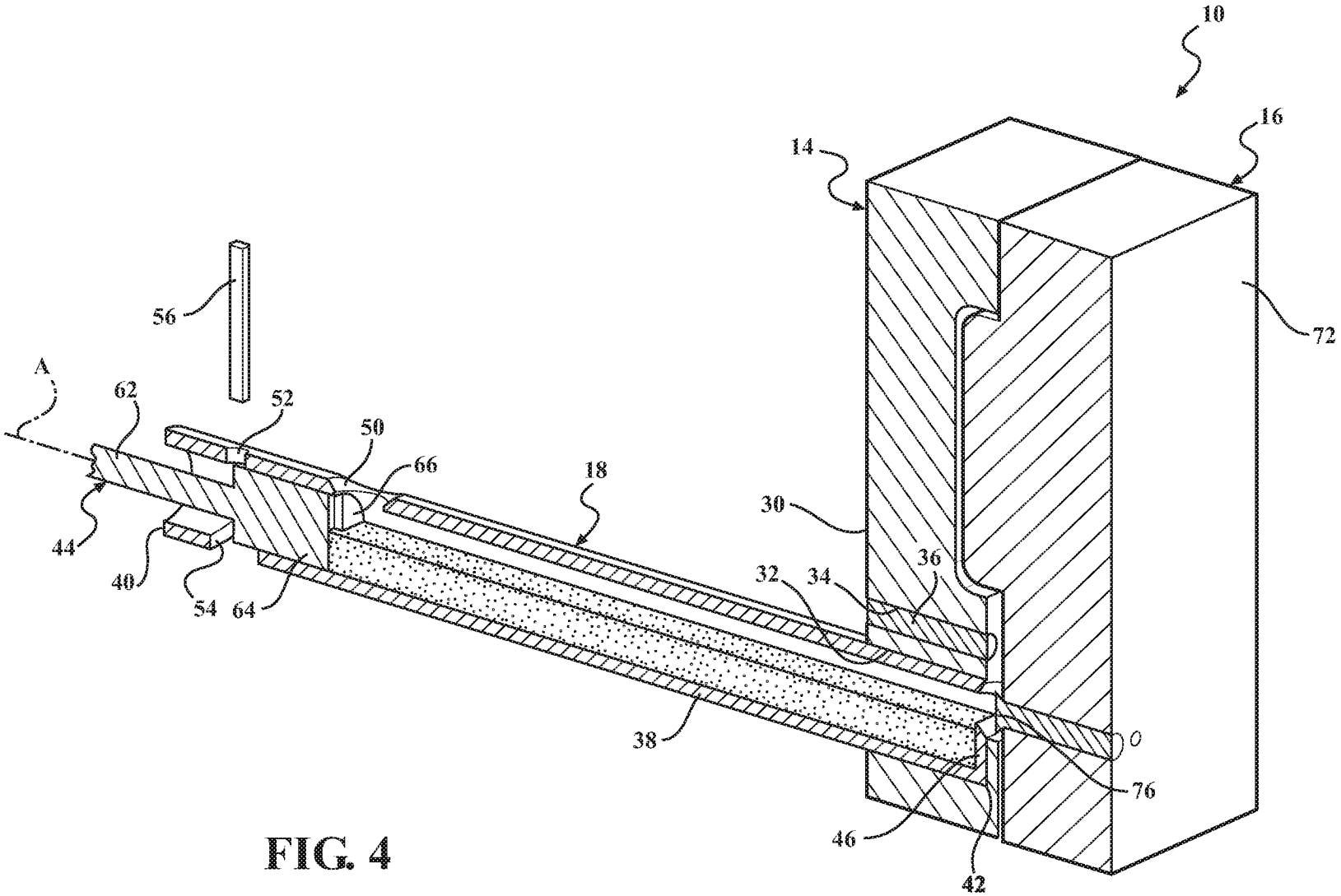
FIG. 4 is a cross-sectional view of the first exemplary die apparatus showing fluid disposed in the shot sleeve when the die apparatus is closed.

After the molten material is poured into the shot sleeve 18, the method includes closing the die apparatus 10 by moving the second die half 16 toward the first die half 14 while maintaining the first die half 14 in a fixed position. FIG. 4 shows the exemplary die apparatus 10 in the closed position with the molten material in the shot sleeve 18. When the die apparatus 10 is closed, the outer edges of the first molding surface 20 engage the outer edges of the second molding surface 68. Also, when the die apparatus 10 is closed, the recessed area 22 of the first molding surface 20 is slightly spaced from the protruded area 70 of the second molding surface 68; and the die opening 24 and the channel 28 of the first molding surface 20 are slightly spaced from the opposing second molding surface 68 such that the first die half 14 and the second die half 16 form the mold cavity therebetween. As shown in FIG. 4, when the die apparatus 10 is closed, the end face of the material separator 36 is aligned with the first molding surface 20. Also, the enlarged end of the hold pin 76 is disposed slightly above the second molding surface 68 and is axially aligned with the die opening 24 of the first die half 14 and the wall opening 48 of the shot sleeve 18.

Figure 5:
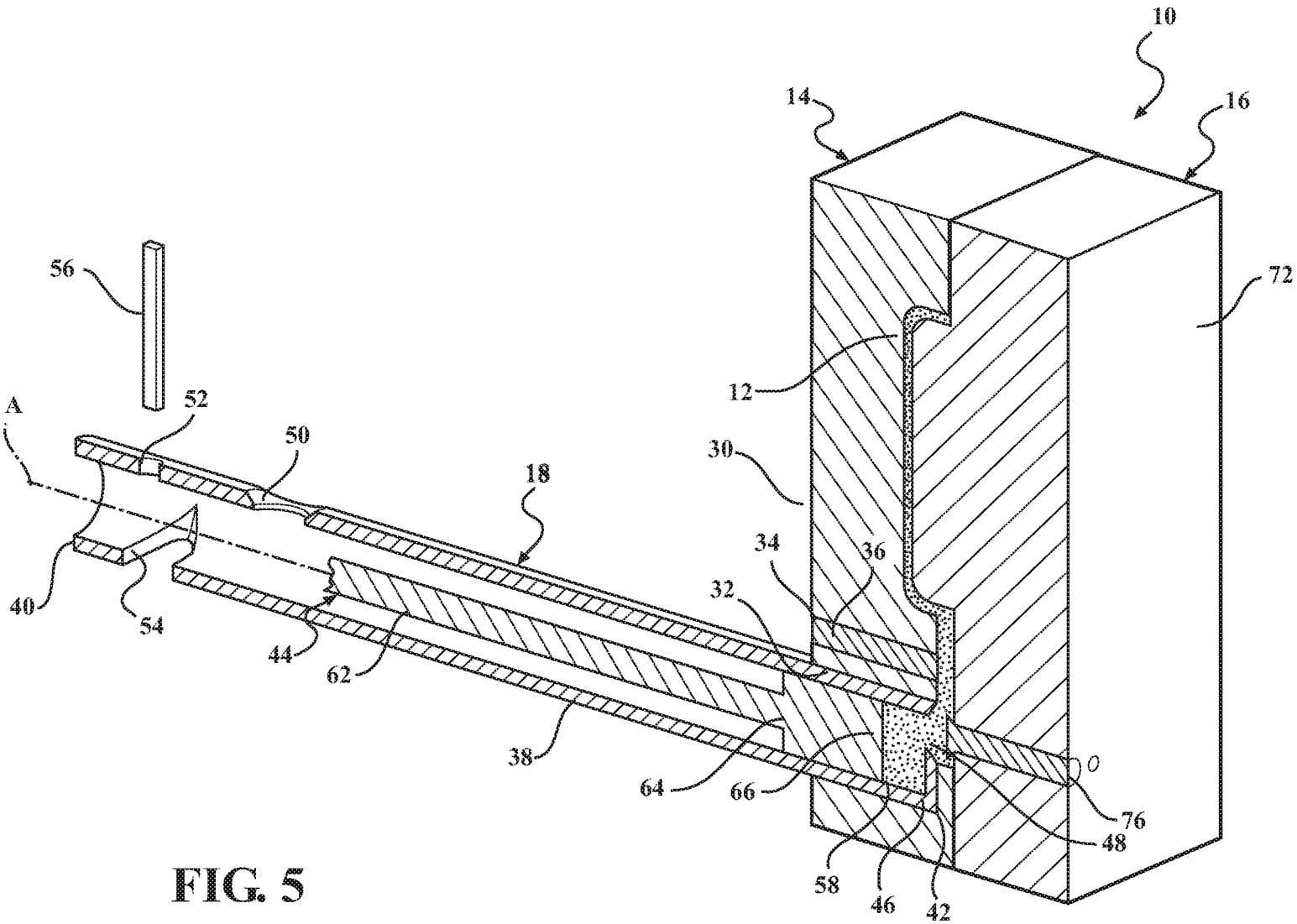
FIG. 5 is a cross-sectional view of the first exemplary die apparatus showing fluid pressed into a mold cavity by the plunger and a biscuit remaining in the shot sleeve when the die apparatus is closed.

The method next includes pushing the molten material through the wall opening 48 of the shot sleeve 18, through the die opening 24 of the first die half 14, around and past the enlarged head of the hold pin 76, and into the mold cavity. This step includes moving the plunger 44 past the pouring hole 50 and toward the partial end wall 46 of the shot sleeve 18 so that the plunger head 64 pushes the molten material through wall opening 48. As shown in FIG. 5, the molten material flows into the mold cavity, fills the mold cavity, and conforms to the shape of molding surfaces 20, 68. The molten material fills the entire volume of the mold cavity along the recessed area 22, the channel 28, and the die opening 24. The plunger 44 stops moving before the serrated surface 66 of the plunger head 64 reaches the partial end wall 46 of the shot sleeve 18, as shown in FIG. 5. Thus, a portion of the molten material remains in the shot sleeve 18 and fills the fluid passage of the shot sleeve 18 between the serrated surface 66 of the plunger head 64 and the partial end wall 46. The molten material extends continuously from the serrated surface 66 through the wall opening 48 and through die opening 24 to the mold cavity. The amount of material disposed along the recessed area 22 is referred to as the part 12. The amount of material disposed in the wall opening 48 and die opening 24, and along the channel 28 of the first die half 14, is referred to as a runner 80. The portion of material that remains in the shot sleeve 18 between the plunger head 64 and the partial end wall 46, after the plunger 44 stops moving, is referred to as the biscuit 58.

Figure 6:
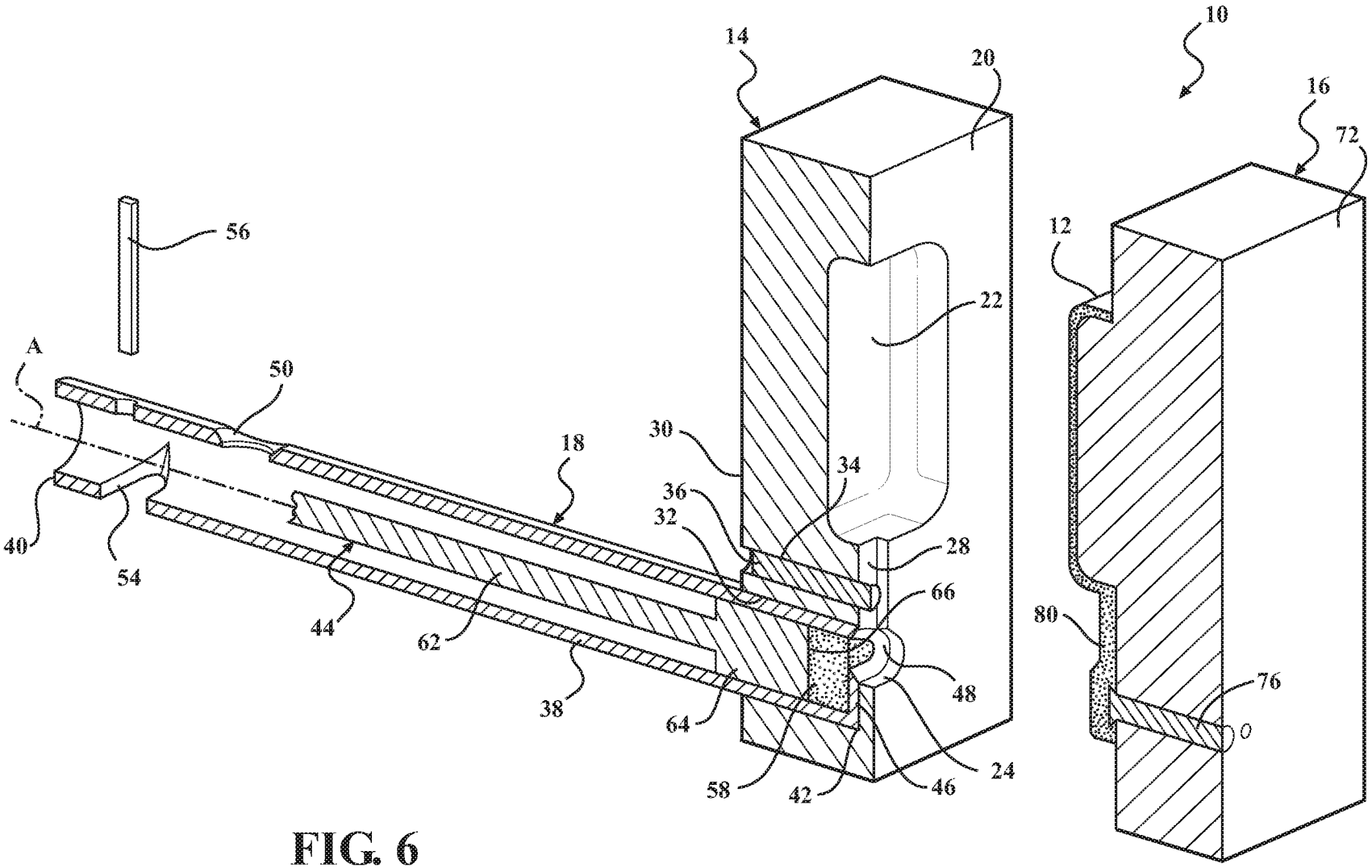
FIG. 6 is a cross-sectional view of the first exemplary die apparatus after the die apparatus is opened and the biscuit is separated from the solidified material on the molding surface.

After the mold cavity is filled and the plunger 44 stops moving toward the partial end wall 46 of the shot sleeve 18, the second die half 16 moves away from the first die half 14 such that the die apparatus 10 is open again. This step is conducted after the runner 80 and the part 12 are solidified, but while the biscuit 58 is still at least partially molten and not fully solidified. As soon the second die half 16 begins moving away from the first die half 14, the biscuit 58 separates from the runner 80, as shown in FIG. 6. The material separator 36 assists with the separation of the biscuit 58 from runner 80 by pressing against the runner 80 as the second die half 16 begins moving away from the first die half 14. The pressure applied to the runner 80 by the material separator 36 causes the biscuit 58 and runner 80 to separate from one another at the wall opening 48, as shown in FIG. 6. The biscuit 58 formed when the second die half 16 moves away from the first die half 14 has a generally flat surface extending continually along the partial end wall 46 and continuously along the wall opening 48 of the shot sleeve 18. Thus, the biscuit 58 completely covers and seals the wall opening 48 of the shot sleeve 18.

The method next includes allowing the runner 80 and part 12 to solidify on the second molding surface 68 of the second die half 16, and then ejecting the solidified runner 80 and part 12 from the second die half 16. As shown in FIG. 7, the ejection pins 78 move upward past the second molding surface 68 to push the part 12 and runner 80 away from the second molding surface 68. The pressure applied to the part 12 and the runner 80 by the ejection pins 78 causes the part 12 and runner 80 to disengage from the hold pin 76 and the protruded area 70 of the second molding surface 68. The plunger 44 remains in the forward position during the ejecting step so that the serrated surface 66 of the plunger head 64 engages the biscuit 58 while the biscuit 58 solidifies. The biscuit 58 completely covers the wall opening 48 of the shot sleeve 18 during the ejecting step, both before and after the biscuit 58 is solidified.

After the runner 80 and part 12 are ejected from the die apparatus 10, the method includes spraying the molding surfaces 20, 68 with a lubricant in preparation for the next casting cycle. During the spraying step, the plunger 44 remains in the forward position so that the serrated surface 66 of the plunger head 64 still engages the biscuit 58, and the solidified biscuit 58 completely covers the wall opening 48 of the shot sleeve 18. The biscuit 58 seals the wall opening 48 and prevents any lubricant from entering the shot sleeve 18 during the spraying step, which is an advantage over the process described in the '724 publication.

After the molding surfaces 20, 68 are sprayed with the lubricant, the method includes moving the plunger 44 away from the second end 42 and back toward the first end 40 of the shot sleeve 18. During this step, the serrated surface 66 of the plunger head 64 remains secured to the solidified biscuit 58 and pulls the biscuit 58 away from the partial end wall 46 and toward the first end 40 of the shot sleeve 18. The dove tail design is preferred for holding the biscuit 58 while moving the biscuit 58 toward the first end 40 of the shot sleeve 18. The plunger 44 moves toward the first end 40 of the shot sleeve 18 until the biscuit 58 is aligned with the biscuit knock out hole 54 and the serrated surface 66 of the plunder head 64 is disposed between the biscuit knockout hole 54 and the first end 40 of the shot sleeve 18, as shown in FIG. 7.

The method next includes removing the solidified biscuit 58 from the shot sleeve 18 so that the shot sleeve 18 is free of material and is ready for the next casting cycle. This step includes pushing the biscuit 58 vertically through the biscuit knock out hole 54 and out of the shot sleeve 18. In the exemplary embodiment, the biscuit knock out component 56 moves through the receiving hole 52 and pushes the biscuit 58 vertically out of the shot sleeve 18. As shown in FIG. 7, the serrated surface 66 of the plunger head 64 with the dove tail design is aligned with the receiving hole 52, and the knock out component 56 slides along the dove tail design. The dove tail design guides the knock out component 56 through the shot sleeve 18. Alternatively, the biscuit 58 can be removed horizontally, for example through the first or second end 40, 42 of the shot sleeve 18.

After the biscuit 58 is removed from the shot sleeve 18, the die apparatus 10 is ready for the next casting cycle. The method includes repeating the steps of pouring the molten material into the shot sleeve 18 while the die apparatus 10 is still open; followed by closing the die apparatus 10; pushing the molten material into the mold cavity; opening the die apparatus 10; ejecting the part 12; and spraying the lubricant on the molding surfaces 20, 68 while the biscuit 58 blocks the wall opening 48 of the tubular sleeve 18, as described above.

Figure 8:
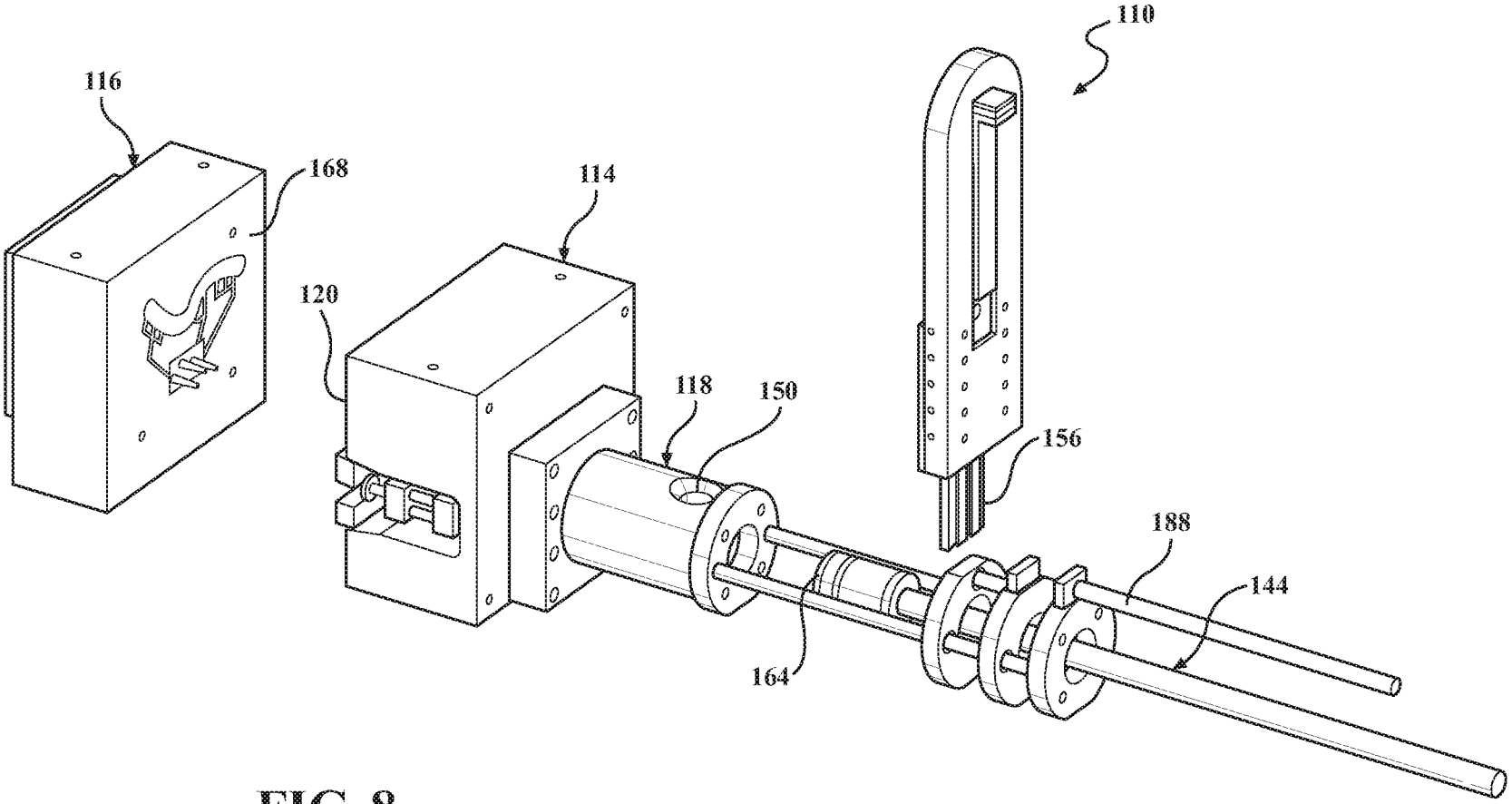
FIG. 8 is a perspective view of the die apparatus in the open position at the beginning of the casting process according to a second exemplary embodiment.

A perspective view of a die apparatus 110 according to a second exemplary embodiment is shown in FIG. 8. FIGS. 9-12 are cross-sectional views of the second exemplary die apparatus 110 during different stages of the casting process.

In the second exemplary embodiment, the first die half 114 again comprises a block with the first molding surface 120 facing the second die half 116. The first die half 114 is fixed in position relative to the second die half 116, and the two die halves 114, 116 provide a mold cavity therebetween when the die apparatus 110 is closed. The contour of the first molding surface 120 and the second molding surface 168 is different from the contour shown in FIGS. 1-7 and thus form a part 112 having a different design.

In the second exemplary embodiment, the die opening 124 of the first die half 114 is much larger than the die opening 24 of the first exemplary embodiment, and the support ledge 126 is a separate piece attached to the remaining block of the first die half 114. Also in this embodiment, the material separator 136 is received in the die opening 124 and is spaced from the partial end wall 146 of the shot sleeve 118 by a spacer plate 182. Instead of a single wall opening 48, the partial end wall 146 defines a plurality of the wall openings 148 for allowing molten material, or another fluid, to flow from the shot sleeve 118 toward the mold cavity. The partial end wall 146 is again disposed in a stationary, fixed position relative to the side wall 138. Preferably, the cross-sectional area of the partial end wall 146 is equal to or greater than one third of the cross-sectional area of the fluid passage.

The material separator 136 of the second exemplary embodiment comprises a break plate which is movable in a direction perpendicular to the first molding surface 120 toward the second molding surface 168. A hydraulic or mechanical drive is typically used to move the material separator 136 relative to the first molding surface 120. As best shown in FIG. 9*a*, the material separator 136 of the second exemplary embodiment includes a plurality of connection openings 184, and the spacer plate 182 includes a plurality of spacer openings 186 each aligned with one of the wall openings 148 for allowing molten material to flow from the shot sleeve 118, through the spacer plate 182 and the material separator 136 into the mold cavity. Like the wall opening 48 and die opening 24 of the first exemplary embodiment, the wall openings 148, connection openings 184, and spacer openings 186 each present a cross-sectional area which increases in a direction moving toward the first molding surface 120. The aligned wall opening 148, connection opening 184, and spacer opening 186 can together be referred to as a sprue opening, because during the casting process, the molten material in the form of a sprue is disposed in those aligned openings 148, 184, 186.

Also in the apparatus 110 of the second embodiment, a plurality of hold pins 176 are disposed in the second die half 116, and each hold pin 176 is aligned with one of the wall openings 148. Unlike the hold pins 76 of the first embodiment, the hold pins 176 of the second embodiment present a cross-sectional area decreasing in a direction moving toward the first die half 114. In addition, the hold pins 176 are movable relative to the second molding surface 168 and thus can assist in ejecting the finished part 112 from the second molding surface 168.

As in the first exemplary embodiment, the shot sleeve 118 is received in the sleeve opening 132 of the first die half 114 and conveys the molten material toward the first molding surface 120. The shot sleeve 118 again includes a pouring hole 150 for receiving the molten material which is located closer to the first end 140 than the second end 142 and is disposed on the same side of the shot sleeve 118 as the wall openings 148. However, in this embodiment, the shot sleeve 118 is shorter and does not include the receiving hole 52 or the biscuit knock out hole 54. Thus, instead of removing the biscuit 158 through the biscuit knock out hole 54, the plunger 144 with the attached biscuit 158 is removed horizontally through the first end 140 of the shot sleeve 118, and then the biscuit 158 is detached from the plunger head 164 by the knock out component 156, which in this case is a knock out plate. Alternatively, the biscuit 158 can be removed vertically from the shot sleeve 118, for example by incorporating the biscuit knock out hole 54 is and receiving hole 52 into the shot sleeve 118.

The apparatus 110 of the second exemplary embodiment further includes a shuttle 188 for moving the plunger 144 relative to the shot sleeve 118. A tip ring 190 is disposed around the head 164 of the plunger 144, and the shuttle 188 is designed to hold the plunger head 164 and tip ring 190 tightly against rotation. The plunger head 164 again includes the serrated surface 166, preferably a dove tail design, as best shown in FIG. 2D to engage the material in the shot sleeve 118.

Figure 9:
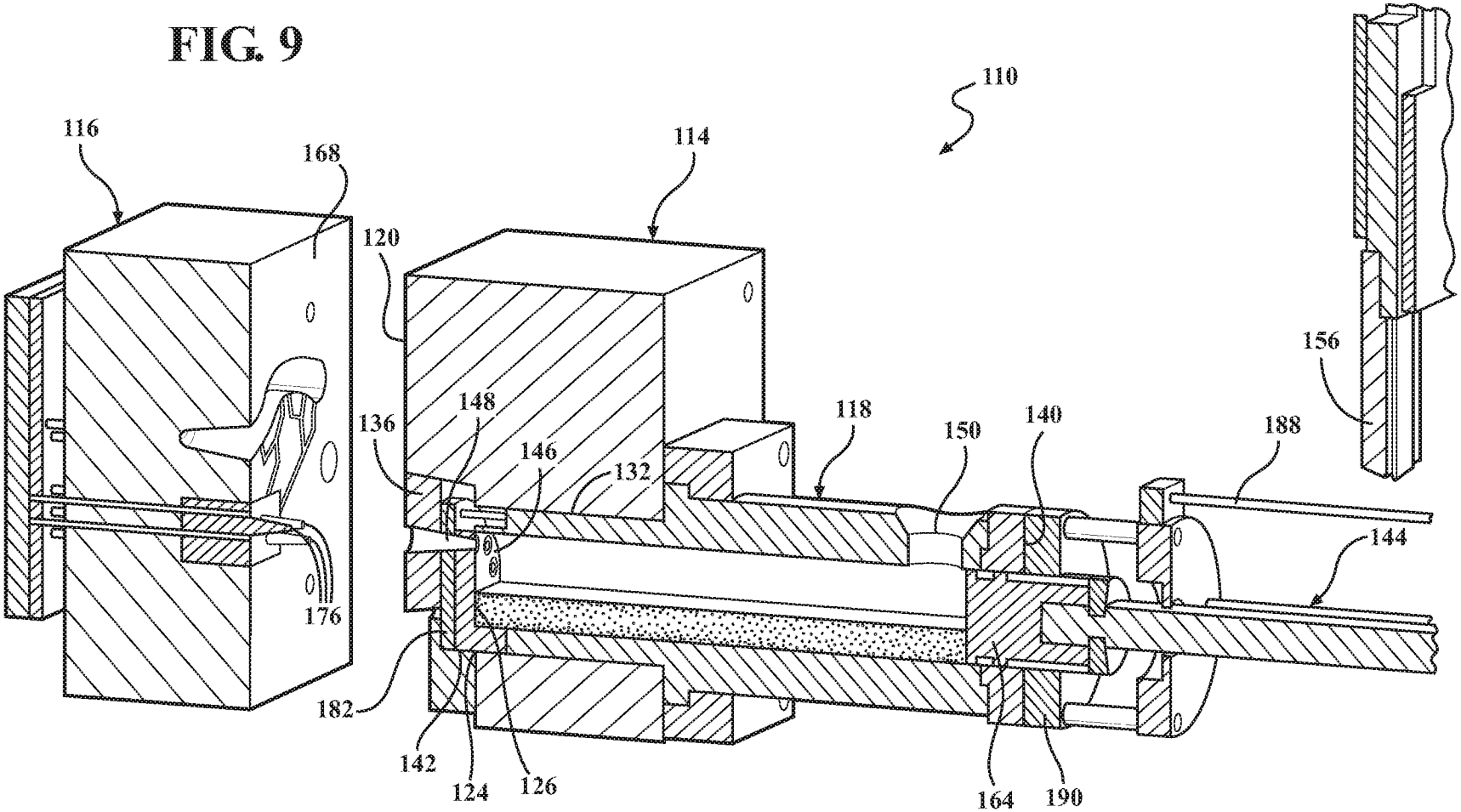
FIG. 9 is a cross-sectional view of the second exemplary die apparatus showing fluid disposed in the shot sleeve while the die apparatus is open.
Figure 10:
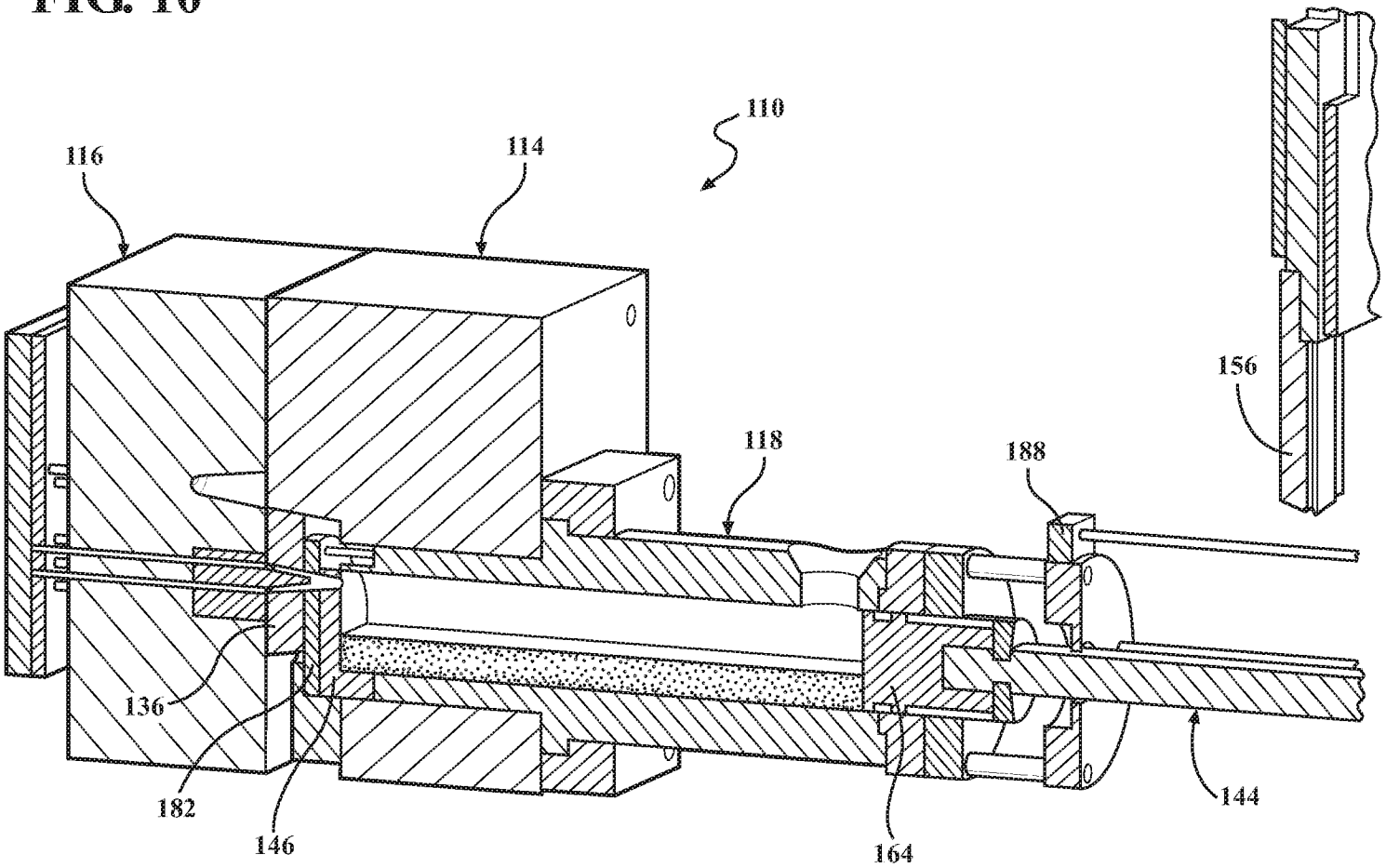
FIG. 10 is a cross-sectional view of the second exemplary die apparatus showing fluid disposed in the shot sleeve when the die apparatus is closed.
Figure 11:
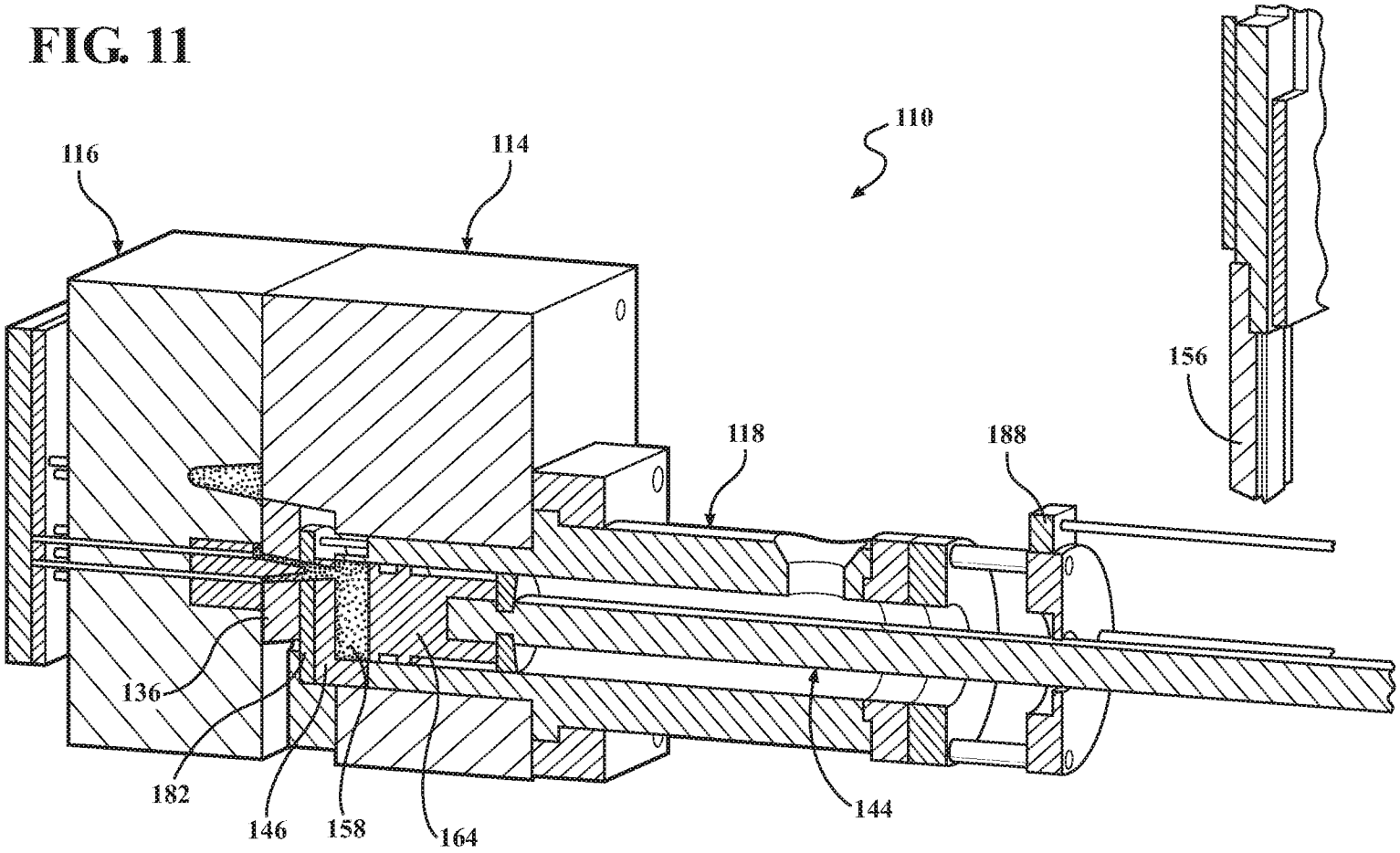
FIG. 11 is a cross-sectional view of the second exemplary die apparatus showing fluid pressed into the mold cavity by the plunger and the biscuit remaining in the shot sleeve when the die apparatus is closed.
Figure 12:
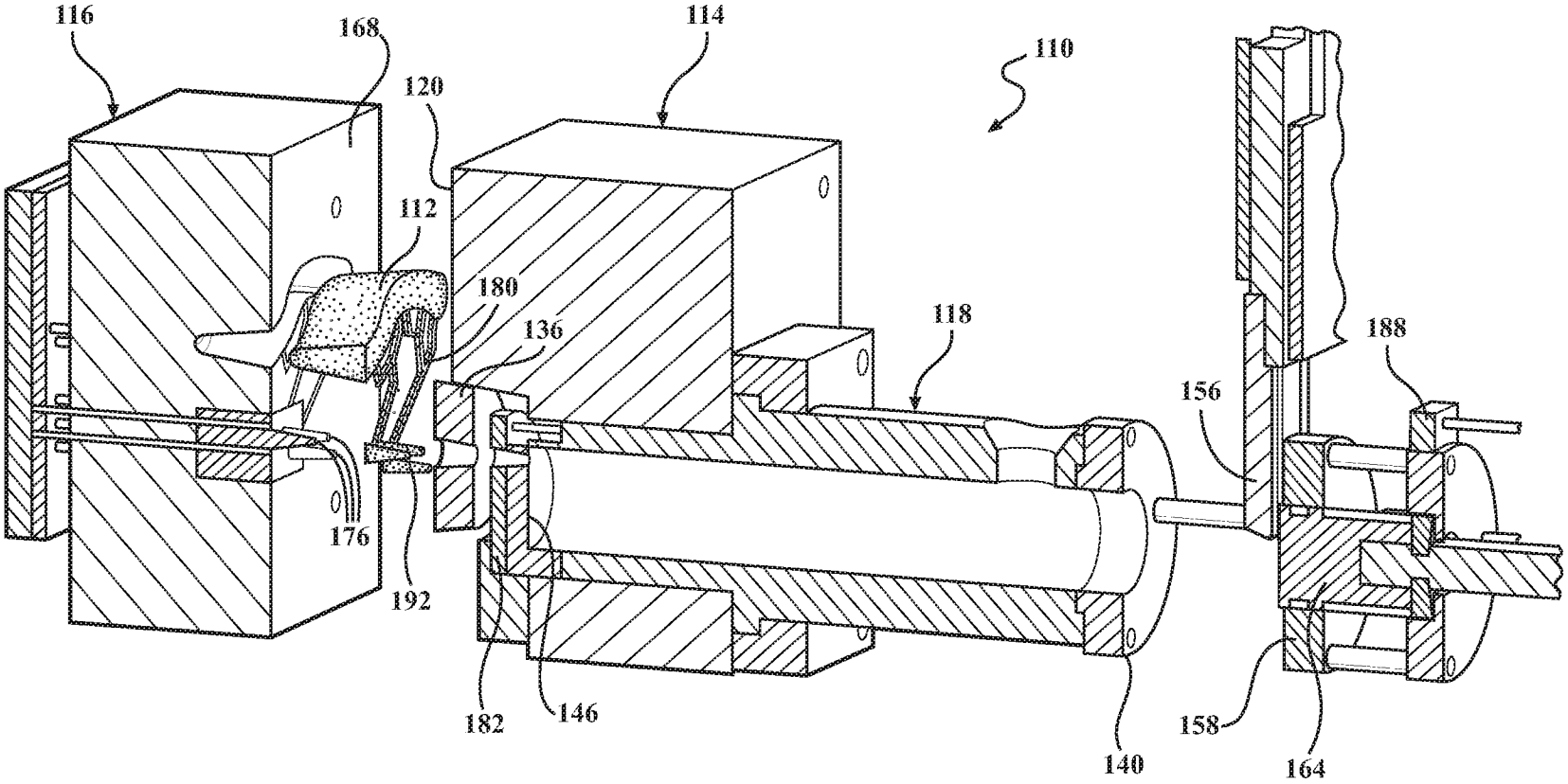
FIG. 12 is a cross-sectional view of the second exemplary die apparatus after the die apparatus is open, solidified material is ejected from the molding surface, and the biscuit is removed from the shot sleeve.

When the apparatus 110 of the second exemplary embodiment is used, the casting process begins by the shuttle 188 moving the plunger head 164 into the shot sleeve 118 such that the shuttle 188 and the plunger head 164 engage the first end 140 of the shot sleeve 118, as shown in FIG. 9. The molten material is then poured into the shot sleeve 118 while the die apparatus 110 is opened. Once the die apparatus 110 closes, the plunger head 164 slides through the shot sleeve 118 and presses the molten material through the wall openings 148 into the mold cavity, as shown in FIGS. 10 and 11. The die apparatus 110 then re-opens while the biscuit 158 is at least partially molten, and the material separator 136 separates the biscuit 158 from the rest of the material shaped between the first and second die halves 114, 116. The solidified material separated from the biscuit comprises the part 112, the runner 180, and a sprue 192, as shown in FIG. 12. The hold pins 176 can be moved relative to the second molding surface 168 to assist in ejecting the solidified material from the apparatus 110. Once the solidified material is ejected, the molding surfaces 120, 168 are sprayed with a lubricant. During the lubrication step, the biscuit 158 blocks the wall openings 148 and prevents the lubricant from entering the shot sleeve 118. After the lubrication step, the shuttle 188 removes the plunger 144 from the shot sleeve 118 along with the solidified biscuit 158, and the biscuit knock out component 156, which in this embodiment removes the biscuit 158 from the plunger head 164, as shown in FIG. 12.

Obviously, many modifications and variations of the present invention are possible in light of the above teachings and may be practiced otherwise than as specifically described with within the scope of the following claims.

The invention claimed is:

1. A die apparatus for die casting, comprising:

a first die half having a first molding surface;

a second die half having a second molding surface facing said first molding surface to present a mold cavity therebetween;

a shot sleeve extending through said first die half toward said first molding surface, said shot sleeve including a side wall presenting a fluid opening for conveying fluid;

said side wall extending to a partial end wall, said partial end wall defining at least one wall opening for allowing fluid to flow from said fluid opening toward said mold cavity;

a plunger disposed in said shot sleeve for pressing fluid through said at least one wall opening;

at least one hold pin extending upwardly from said second molding surface, and each of said at least one hold pin being axially aligned with one of said at least one wall opening, and said at least one hold pin includes an enlarged head presenting a cross-sectional area increasing in a direction moving toward said first die half.

2. The die apparatus of claim 1, wherein said at least one hold pin presents a cross-sectional area decreasing in a direction moving toward said first die half.

3. The die apparatus of claim 1, wherein said at least one hold pin is received in said second die half, each of said at least one hold pin is axially aligned with a die opening and one of said at least one wall opening;

said second die half comprises a block of material aligned with and movable relative to said first die half;

said second die half includes a second back surface facing opposite said second molding surface; and said second die half defines at least one hold pin opening along said second molding surface, and each of said at least one hold pin opening receives one of said at least one hold pin.

4. The die apparatus of claim 1 including a material separator disposed along one of said molding surfaces and movable relative to said molding surface.

5. The die apparatus of claim 4, wherein said material separator is a push pin received in said first die half and disposed along said first molding surface, and said push pin is movable in a direction perpendicular to said first molding surface.

6. The die apparatus of claim 4, wherein said material separator is movable in a direction perpendicular to said first molding surface;

said side wall of said shot sleeve extends along a center axis from a first end to a second end and circumferentially around said center axis to form said fluid passage;

said fluid passage presents a cross-sectional area extending perpendicular to said center axis and parallel to said first molding surface;

said first end of said shot sleeve is open and receives said plunger;

said partial end wall of said shot sleeve is disposed in a fixed position and stationary relative to said side wall of said shot sleeve and said first molding surface;

said partial end wall of said first die presents a cross-sectional area extending perpendicular to said center axis and parallel to said first molding surface, and said cross-sectional area of said partial end wall is greater than or equal to one third of said cross-sectional area of said fluid passage, and said partial end wall is disposed along one side of said shot sleeve;

each of said at least one wall opening of said shot sleeve presents a cross-section area extending perpendicular to said center axis and parallel to said first molding surface, said cross-sectional area of each of said at least one wall opening is less than said cross-sectional area of said axially aligned die opening, and said cross-sectional area of each of said at least one wall opening increases in a direction moving toward said axially aligned die opening.

7. A die apparatus for die casting, comprising:

a first die half having a first molding surface;

a second die half having a second molding surface facing said first molding surface to present a mold cavity therebetween;

a shot sleeve extending through said first die half toward said first molding surface, said shot sleeve including a side wall presenting a fluid opening for conveying fluid;

said side wall extending to a partial end wall, said partial end wall defining at least one wall opening for allowing fluid to flow from said fluid opening toward said mold cavity;

a plunger disposed in said shot sleeve for pressing fluid through said at least one wall opening;

at least one hold pin extending upwardly from said second molding surface, and each of said at least one hold pin being axially aligned with one of said at least one wall opening;

a material separator disposed along one of said molding surfaces and movable relative to said molding surface, wherein said material separator is a break plate received in said first die half between said partial end wall of said shot sleeve and said first molding surface, said break plate is movable in a direction perpendicular to said first molding surface, said break plate defines at least one connection opening extending therethrough, and each connection opening is axially aligned with one of said at least one wall opening for allowing fluid to flow from said shot sleeve through said break plate and toward said mold cavity.

8. The die apparatus of claim 7, wherein said at least one hold pin includes an enlarged head presenting a cross-sectional area increasing in a direction moving toward said first die half.

* * * * *